United States Patent [19]

Gentile

[11] 3,977,589

[45] Aug. 31, 1976

[54] IDLER ROLLER ASSEMBLY FOR PUNCH PRESS FEED

[75] Inventor: P. J. Gentile, Pittsburgh, Pa.

[73] Assignee: Vamco Machine and Tool, Inc., Pittsburgh, Pa.

[22] Filed: Apr. 14, 1975

[21] Appl. No.: 567,690

[52] U.S. Cl. ..... 226/180; 226/194

[51] Int. Cl.[2] ..... B65H 17/22

[58] Field of Search ..... 226/180, 181, 190, 194, 226/176, 177

[56] References Cited

UNITED STATES PATENTS

| | | | |
|---|---|---|---|
| 2,092,185 | 9/1937 | Ross | 226/180 X |
| 3,233,807 | 2/1966 | Wray | 226/180 |
| 3,257,056 | 6/1966 | Cederberg | 226/176 |

*Primary Examiner*—Richard A. Schacher
*Attorney, Agent, or Firm*—Stanley J. Price, Jr.

[57] ABSTRACT

An idler roller assembly is provided which permits angular adjustment of the idler roller relative to the housing of the punch press feed so that accurate tracking of the feed stock may be accomplished. The idler roller rotates within a frame that is supported by trunions within the housing of the feed. The trunions permit pivoting of the frame to move the idler roller toward and away from the driven roller of the feed. An eccentric adjustment is provided between one of the trunions and the housing of the feed so that minute angular adjustments may be made to the idler roller.

8 Claims, 3 Drawing Figures

IDLER ROLLER ASSEMBLY FOR PUNCH PRESS FEED

BACKGROUND OF THE INVENTION

Punch press feeds are known in the art and usually provide a driven roll and an idler roll which cooperate with each other to carry feed stock between them to the dies of the punch press. In order to operate efficiently, the rolls of the feed must track the feed stock accurately toward the dies of the press. If the feed stock is not directed in an accurate fashion, it will run to the side of the dies and prevent high-speed feeding and operation of the punch press.

It has been found that the rolls of the feed must be precisely aligned so that they may feed the stock accurately. Manufacturing tolerances often leave the feed rolls slightly misaligned and in an improper position.

The present invention is directed to a idler roller assembly for a punch press feed which permits minute adjustment of the idler roller relative to the housing of the feed, and so relative to the driven roller of the feed, so that accurate feeding of the stock may be accomplished.

The idler roller assembly of the present invention has an eccentric adjustment between the frame of the idler roller and the housing of the feed so that the eccentric adjustment, upon rotation, will adjust the axis about which the frame of the idler roller pivots during its operation.

SUMMARY

The present invention is directed to a novel adjustable idler roller assembly which has a frame that rotatably receives the idler roller. The frame pivots on trunions that are received by the housing of the feed. Universal bearings are utilized within the housing to receive the trunions and permit minute rotation of the axis of the trunions relative to the housing. An eccentric sleeve between the housing and one trunion of the frame permits a shift of the axis of the trunion and thereby causes a shift of the idler roller itself.

With the foregoing considerations in mind, it is an object of the present invention to provide an improved idler roller assembly for a punch press feed.

Another object of the present invention is to provide an idler roller assembly having an eccentric adjustment to permit adjustment of the idler roller relative to the housing of the feed.

These and other objects of the present invention will become apparent as this description proceeds in conjunction with the accompanying drawings.

DESCRIPTION OF THE PREFERRRED EMBODIMENT

Figure 1:
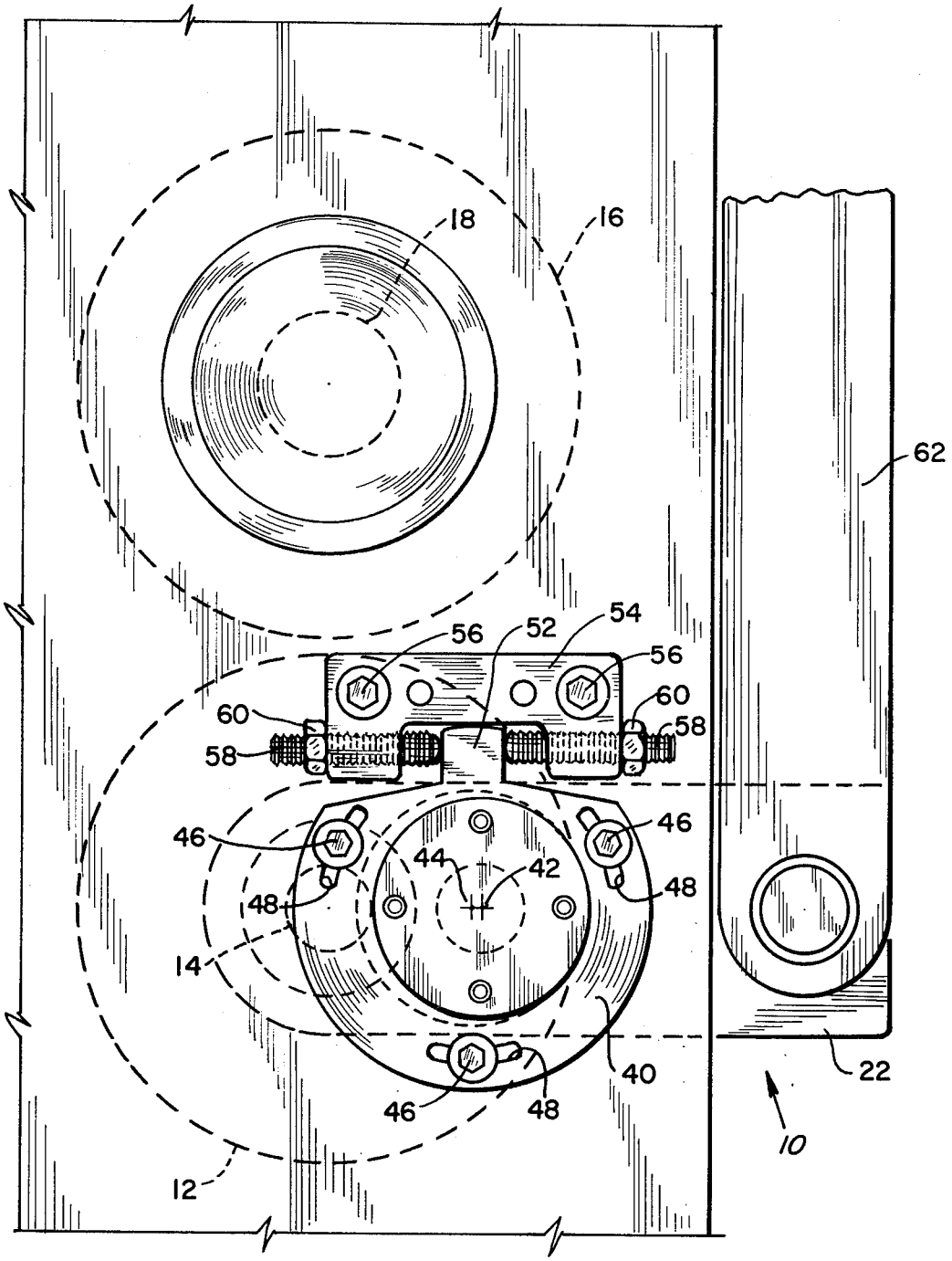
FIG. 1 is a side elevation of the idler roller assembly of the present invention showing a portion of the housing of the punch press feed.
Figure 2:
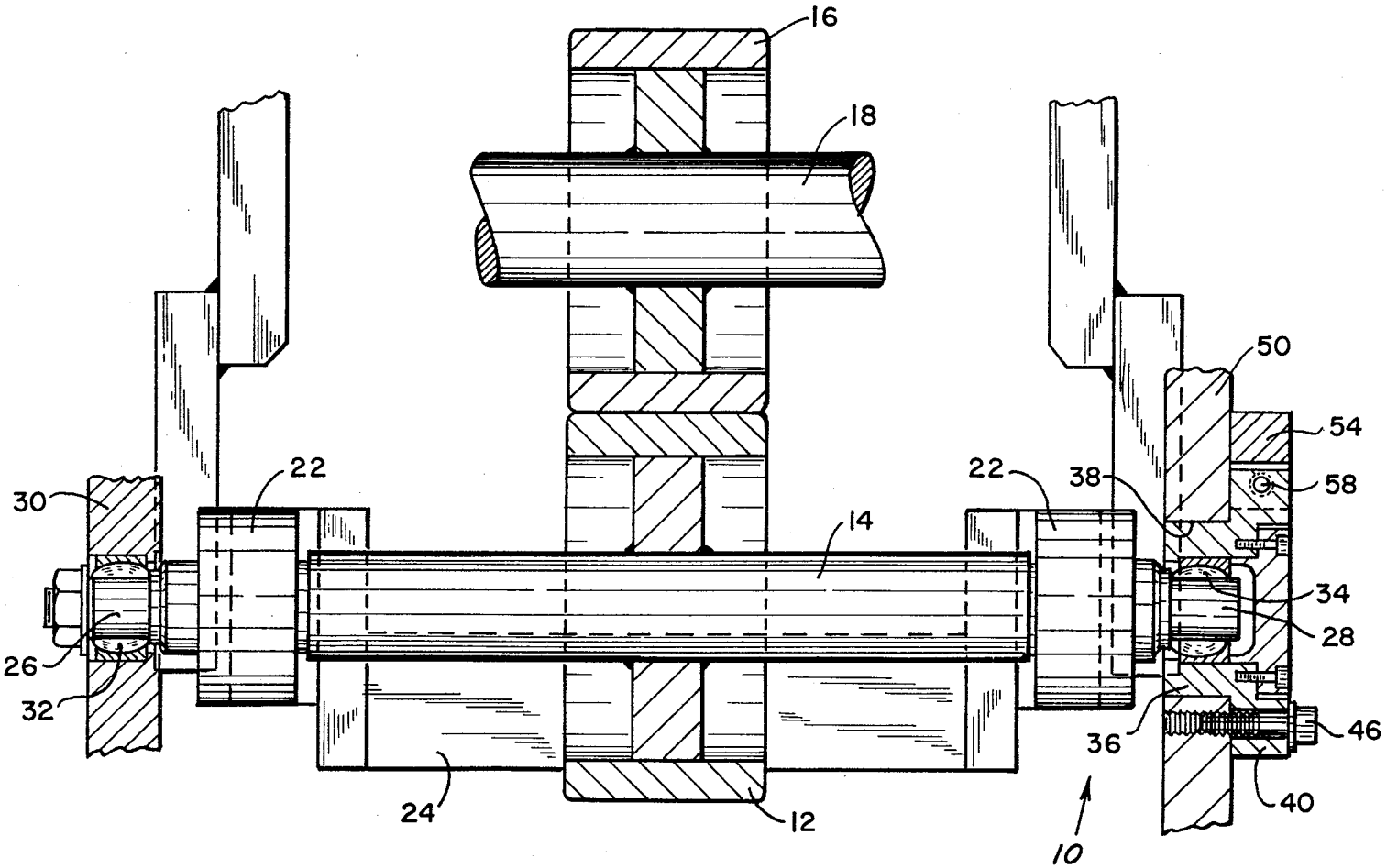
FIG. 2 is a front elevation, partially in section, of the idler roller assembly of FIG. 1.
Figure 3:
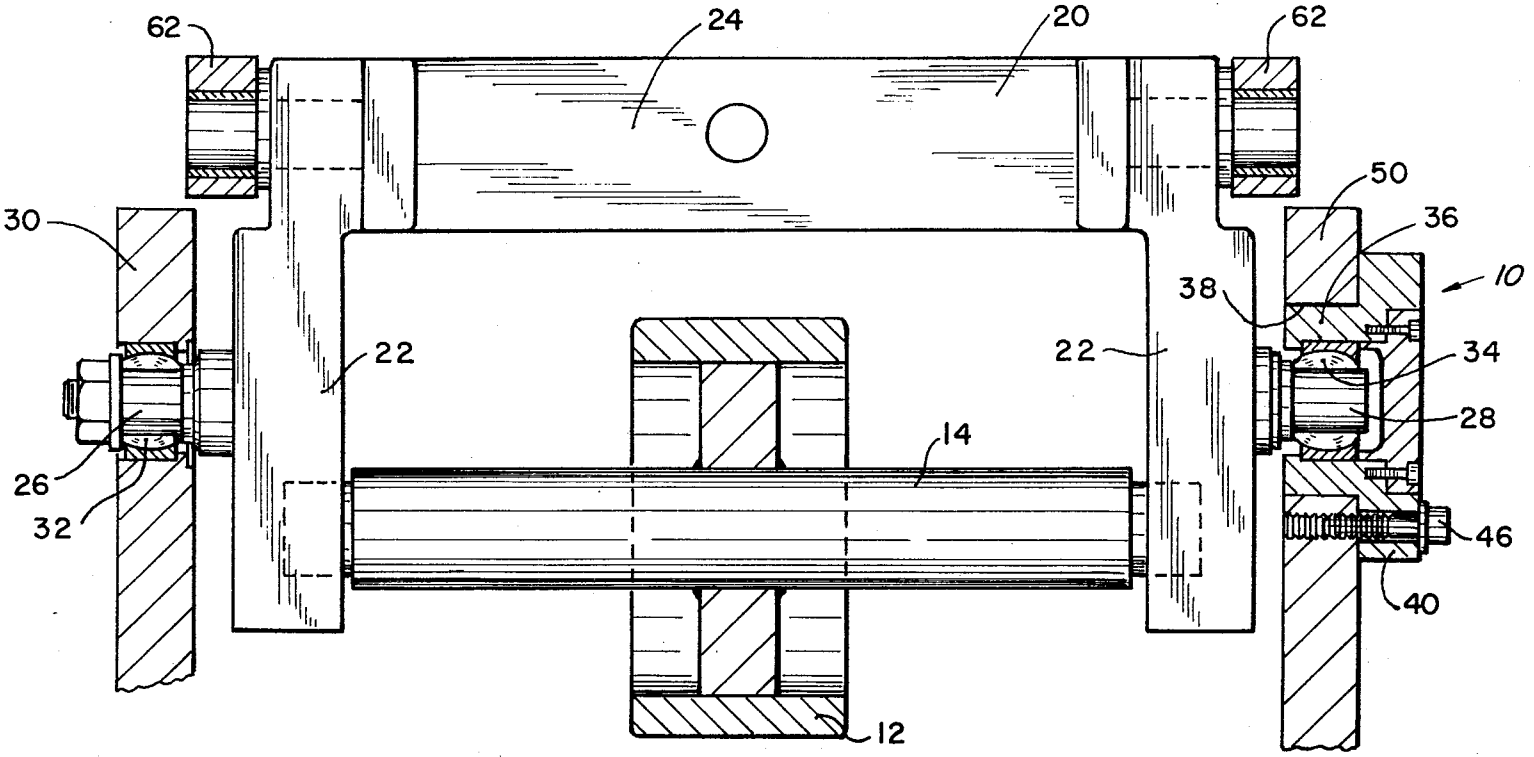
FIG. 3 is a top plan view, partially in section, of the idler roller assembly of FIGS. 1 and 2.

The idler roller assembly of the present invention is the type utilized with a punch press feed as shown generally in U.S. Pat. No. 3,483,782 issued to Harry Eyberger on Dec. 16, 1969, and entitled "Self-Contained Feed Roll for Power Punch Presses." That patent describes a feed for power punch presses that has a driven feed roll and an idler feed roll which cooperate to feed stock to the punch press. The idler feed roll periodically moves away from the driven feed roll to permit the stock to center itself as the punch press actually punches a particular item during the punching operation. The idler roll then moves back toward the driven roll in order to permit the next increment of stock to be fed to the dies of the punch press.

Referring to the drawings, there is shown an idler roller assembly 10 which has an idler roller 12 fixed to a rotatable shaft 14. The idler roller 12 cooperates with driven roller 16 that is fixed to a driven shaft 18. Driven shaft 18 is driven by a mechanism (not shown) similar to the type described in the aforesaid U.S. Pat. No. 3,483,782.

The shaft 14 of the idler roller 12 is journaled for rotation within a frame 20 which consists of arms 22 connected to a cross member 24 as a unit. A trunion 26 is formed on one of the arms 22 and a co-axial trunion 28 is formed on the other arm 22. Trunion 26 is received for rotation within housing wall 30 of the punch press feed and a spherical universal bearing 32 permits rotation of the trunion 26 relative to housing wall 30 and also permits the axis of the trunion to be tilted slightly.

A similar spherical universal bearing 34 is provided for the other trunion 28. Bearing 34 is received within an eccentric sleeve 36. The eccentric sleeve 36 is received within a cylindrical opening 38.

A flange 40 is formed on eccentric sleeve 36 and extends radically outwardly therefrom.

As best seen in FIG. 1, the axis of trunions 26 and 28 is indicated at 42. The axis 44 of the cylindrical surface of sleeve 36 is offset from the axis 42 of the trunions and eccentric thereof. Since the bearing 34 fits within the internal cylindrical surface of sleeve 36 and the external cylindrical surface of sleeve 36 has a different center than trunion 28, it may be seen that the two cylindrical surfaces of the sleeve 36 are eccentric relative to each other for a purpose to be described.

The sleeve 36 has bolts 46 passing through elongated holes 48 formed within the flange 40 of the eccentric sleeve 36. The bolts 46 are threaded into the housing wall 50 of the punch press feed.

As best shown in FIG. 1, a portion of the flange 40 of eccentric sleeve 36 is relieved so as to form a protrusion 52 on the flange 40. The protrusion 52 extends upwardly into a yoke 54 that is bolted to the housing wall 50 by bolts 56.

Threaded studs 58 are threaded through the yoke 54 into contact with protrusion 52 of flange 40. Lock nuts 60 are provided on studes 58 to lock them into position once they have been adjusted to properly position protrusion 52.

Actuator arms 62 are provided to rotate frame 20 about the axis of trunions 26 and 28 to thereby cause the idler roll 12 to move toward and away from driven roller 16. The actuator arms 62 are driven by a source of power (not shown) in conventional fashion and form no part of the present invention.

OPERATION

Under normal operating circumstances, the idler roller 12 is urged toward the driven roller 16. When driven roller 16 is turned, feed stock is fed between rollers 16 and 12 into the dies of the punch press (not shown). During each cycle of the punch press, the actuator arms 62 are actuated to raise arms 22 (FIG. 1) and thereby rotate the arms 22 in a counterclockwise direction as viewed in FIG. 1, so that arms 22 pivot about the axis 42 of trunions 26 and 28 thereby lowering the idler roller shaft 14 and idler roller 12 away from driven roll 16. When the idler roller 12 is so lowered, the feed stock between the idler roller 12 and driven roller 16 is free to adjust itself on the dies of the punch press (not shown) for the punching stroke.

In order to adjust the frame 20 which is supported by trunions 26 and 28 relative to the housing walls 30 and 50, the eccentric sleeve 36 may be rotated relative to housing wall 50. To accomplish the rotation, bolts 46 are loosened slightly. The threaded studs 58 are then rotated so that the protrusion 52 on flange 40 of eccentric sleeve 36 is moved in one direction or the other, depending upon the type of adjustment required.

The axis of cylindrical opening 38 in housing wall 50 and the axis of outer cylindrical surface of eccentric sleeve 36 are coincident and the eccentric sleeve 36 rotates within cylindrical opening 38 when the protrusion 52 is moved. Because trunion 28 has its axis 42 offset from the axis 44 of the outer cylindrical surface of eccentric sleeve 36, rotation of sleeve 36 causes the axis 42 of trunion 28 to shift slightly in a radical direction depending upon the rotation of sleeve 36.

After an appropriate adjustment has been made to shift the axis of the trunion 28, the lock nuts 60 are secured against yoke 54 and the bolts 46 are tightened to secure the flange against housing 50. It will be seen that the elongated holes 48 permit the rotation of flange 40 and sleeve 36 relative to the housing 50 when bolts 46 are loosened.

The eccentric adjustment of the present invention is provided only at trunion 28. Trunion 26, which is coaxial with trunion 28, shifts slightly in its cylindrical universal bearing 32 when the axis of trunion 28 is shifted by means of sleeve 36.

By shifting the axis 42 of trunions 26 and 28, a slight amount, the entire frame 20 is shifted a slight amount. This shifting of frame 20 shifts the axis of shaft 14 and the idler roller 12 can be moved a small amount relative to driven roller 16 so that the tracking characteristics of the material fed to the punch press may be improved.

According to the provisions of the patent statutes, I have explained the principle, preferred construction, and mode of operation of my invention and have illustrated and described what I now consider to represent its best embodiment. However, I desire to have it understood that, within the scope of the appended claims, the invention may be practiced otherwise than as specifically illustrated and described.

I claim:

1. An idler roller assembly for a punch press feed having a driving roller and a cooperating idler roller wherein said idler roller is selectively movable away from said driven roller, said idler roller assembly comprising:

a. an idler roller;

b. a frame rotatably receiving said idler roller;

c. co-axial trunion means pivotally supporting said frame within the housing of said punch press feed;

d. eccentric adjustment means interposed between said trunion means and said housing whereby minute adjustments may be made to the angular relationship between said idler roller and said housing;

said frame being pivotable about said trunion means axis to selectively move said idler roller away from said driven roller.

2. The idler roller assembly of claim 1 wherein said co-axial trunion means are supported by universal bearings.

3. The idler roller assembly of claim 1 wherein said co-axial trunion means has at least one trunion supported within a cylindrical sleeve, the cylindrical surface of said sleeve having an axis which does not coincide with the axis of said trunion means whereby said cylindrical sleeve may be rotated relative to said housing to adjust the axis of said trunion means relative to said housing.

4. The idler roller assembly of claim 3 wherein said cylindrical sleeve has a flange at one end, said flange being secured in position on said housing by means of bolts extending through elongated holes in said flange whereby rotation of said sleeve relative to said housing through a limited range may be accomplished.

5. The idler roller assembly of claim 4 wherein said cylindrical sleeve is rotated by means of threaded adjustment studs fixed to said housing and abutting said sleeve flange.

6. The idler roller assembly of claim 2 wherein said universal bearing means is supported directly within said housing at one end of said trunion means and is supported within an eccentric sleeve arrangement at the other end of said trunion means.

7. The idler roller assembly of claim 1 wherein said idler roller is supported within said frame near one end of said frame and said trunion means is located between said idler roller and the other end of said frame.

8. The idler roller assembly of claim 2 wherein said universal bearings are of the spherical type.

* * * * *